United States Patent [19]

Lampson

[11] 4,243,148

[45] Jan. 6, 1981

[54] COUNTERBALANCED TOWER CRANE

[75] Inventor: Neil F. Lampson, Kennewick, Wash.

[73] Assignee: Riggers Manufacturing Company, Kennewick, Wash.

[21] Appl. No.: 40,234

[22] Filed: May 18, 1979

[51] Int. Cl.[3] ..... B66C 23/76

[52] U.S. Cl. ..... 212/196

[58] Field of Search ..... 212/49, 58 R, 145, 8 R, 212/48, 57, 46 A, 144

[56] References Cited

U.S. PATENT DOCUMENTS

| | | | |
|---|---|---|---|
| 3,777,900 | 12/1973 | Brewer | 212/58 R |
| 3,794,194 | 2/1974 | Higgins | 212/46 A |
| 3,836,010 | 9/1974 | Lampson | 212/49 |
| 3,842,984 | 10/1974 | Brown et al. | 212/49 |
| 3,868,022 | 2/1975 | Greenlay et al. | 212/8 R |
| 3,921,815 | 11/1975 | Brown | 212/3 |
| 3,930,583 | 1/1976 | Jouffray | 212/49 |
| 3,955,684 | 5/1976 | Novofny | 212/48 |
| 4,103,783 | 8/1978 | Beduhn | 212/48 |
| 4,170,309 | 10/1979 | Lampson | 212/49 |
| 4,194,638 | 3/1980 | Morrow, Sr. et al. | 212/58 R |

FOREIGN PATENT DOCUMENTS

| | | |
|---|---|---|
| 1246969 | 9/1965 | Fed. Rep. of Germany . |
| 1294010 | 4/1966 | Fed. Rep. of Germany . |
| 6405689 | 12/1965 | Netherlands . |

*Primary Examiner*—James B. Marbert

*Attorney, Agent, or Firm*—Wells, St. John & Roberts

[57] ABSTRACT

A vertical tower and lifting boom are counterbalanced by a separately supported counterweight unit. The counterweight unit is self-propelled and connected to a mobile tower platform by a horizontal stinger. A diagonal tower brace extends between the outer end of the stinger and the upper end of the tower for transmission of rotational forces about the vertical tower axis. A vertical counterweight strut is connected between the counterweight unit and the outer end of a pivoted staymast that extends rearwardly in opposition to the boom.

8 Claims, 19 Drawing Figures

COUNTERBALANCED TOWER CRANE

BACKGROUND OF THE INVENTION

This disclosure relates to tower cranes, which are used for high lifts of loads, particularly in building erection. Tower cranes are characterized by a vertical tower, in contrast to the inclined booms of conventional cranes. The pivoted upper jib of a conventional crane is replaced by a much longer pivoted boom that is raised or lowered to place the load at the desired radial position relative to the tower axis.

Conventional tower cranes are counterweighted on the supporting carriage at the base of the tower. The overturning moment produced by the weight of the load multiplied by its distance from the tower axis is counterbalanced by a heavy counterweight spaced to the opposite side of the tower axis on the tower base or carriage. The overturning moment must always be smaller than the counterbalancing moment. This limitation restricts the maximum load permitted on the tower crane at a given radius. The maximum available separation between the counterweight and tower is limited by structural considerations when the counterweight is cantilevered from the supporting carriage at the base of the tower. In practice, this maximum spacing between the counterweight and tower axis is limited to about ten to fifteen feet. These spatial and structural limitations have in turn limited the amount of design load which can be suspended from a conventional tower crane.

Another common problem with respect to tower cranes is the tendency of the unloaded boom to fall backward over the tower due to the moment applied to it by the supporting rigging. It is common practice to use safety straps or cables between the tower and boom to limit the upward angle of the boom relative to the vertical tower axis. These straps or cables effectively prevent the boom from being pulled too high when unloaded but also limit the minimum radius at which loads can be lifted.

While the use of safety straps or cables between the tower and boom are not unduly restrictive in a conventinal tower crane, where the counterweight and attached rigging is not appreciably to the rear of the tower, much more serious problems are encountered when designing a tower crane having a counterweight spaced a substantially greater distance to the rear of the tower. Such spacing is made practical by supporting the counterweight on an independent self-powered crawler platform. This requires use of an elongated staymast that extends rearwardly or opposite to the boom. The potential moment exerted on the raised, unloaded boom by the combined weight of the staymast and rigging would require safety straps or cables beyond practical strength limitations, or would require such severe angular limitations on the operation of the boom as to make its utilization impractical in many applications.

As an example of a tower crane using a conventional counterweight assembly on a supporting carriage, and illustrating the use of safety cables between the boom and tower, reference is made to the disclosure of U.S. Pat. No. 3,794,184, which was issued to Robert J. Higgins on Feb. 26, 1974. The disclosure of this patent is incorporated herein by reference.

In my co-pending U.S. patent application, Ser. No. 877,816, filed Feb. 14, 1978, there is disclosed a tower crane having a rigid strut extending between a rearwardly spaced counterweight unit and the vertical tower. The counterweight unit is structurally connected to the base of the tower by a horizontal spreader or stinger which completes a triangular frame. The horizontal and diagonal legs of the triangular frame transmit rotational forces from the self propelled counterweight unit to both the base and upper end of the vertical tower. This earlier apparatus required a lifting crane for erection. While it was usable by itself where the boom could always be maintained at low angles relative to the tower, many practical applications of this structure required its use in conjunction with a guy derrick to serve as a boom stop beneath the staymast.

According to the present invention, a rigid counterweight strut extends between the staymast and the remote counterweight unit. It replaces the usual backstay lines and serves as a tension member when a load is being lifted at the outer end of the boom. More importantly, it eliminates the need for excessive safety straps or cables between the boom and tower and allows the unit to be designed with light safety straps or cables adequate only to prevent the boom itself from falling backwards over the tower. The counterweight strut also serves an important function during erection of the apparatus in providing the necessary lifting forces to make the structure substantially self-erecting.

BRIEF DESCRIPTION OF THE DRAWINGS

FIG. 3 is a diagrammatic view of the present tower crane ready for assembly;

DESCRIPTION OF THE PREFERRED EMBODIMENT

A preferred form of a tower crane incorporating the present invention is schematically shown in the accompanying drawings. It includes a vertical tower 15 supported on a self-propelled transporter 11. The transporter 11 includes independent tracks 12 driven by a power source 13. The power source 13 might be one or more internal combustion engines or suitable electric or hydraulic motors that are operatively connected to the tracks to drive each track independently of the other.

Figure 1:
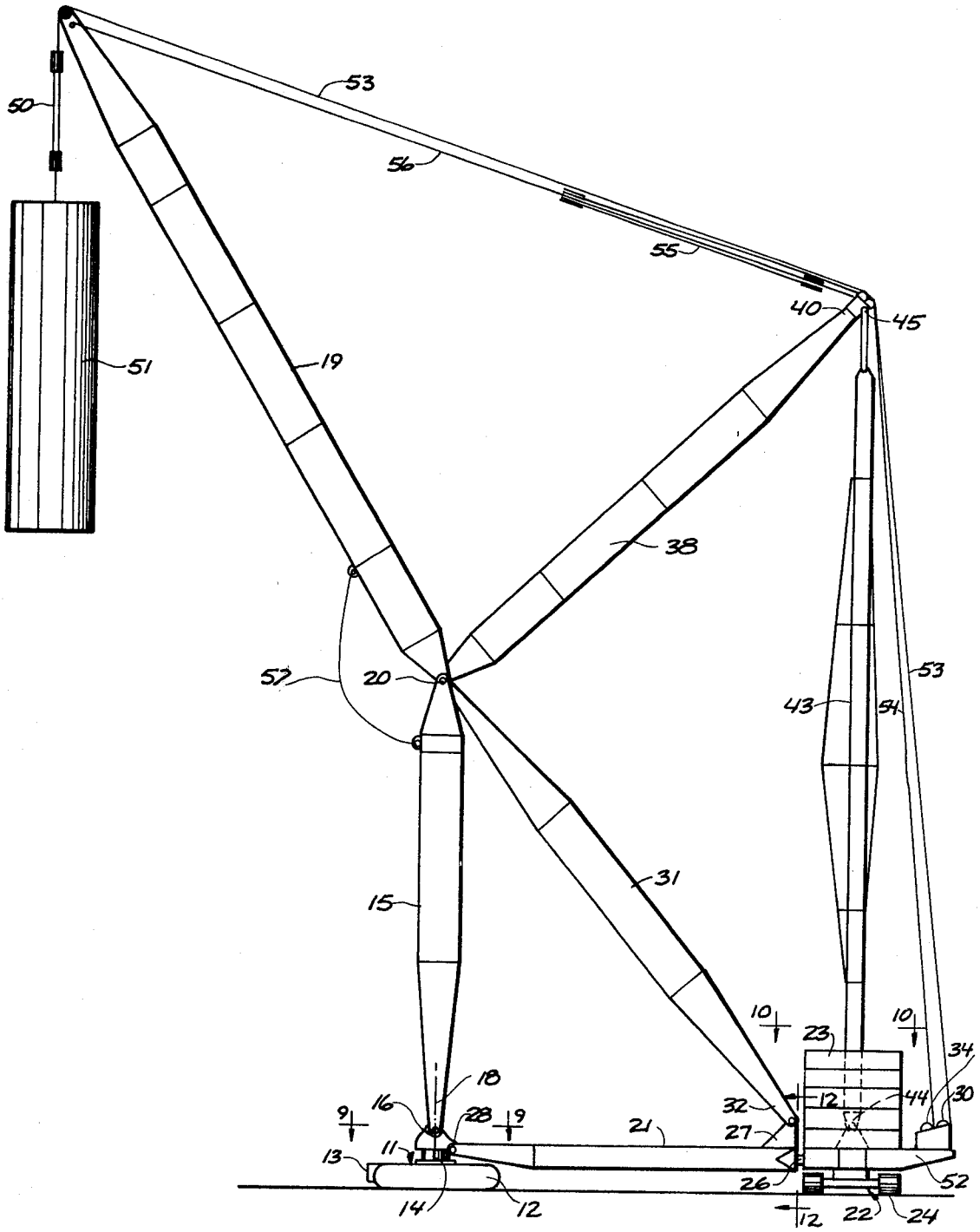
FIG. 1 is an elevational diagrammatic view of the present counterbalanced tower crane.
Figure 1:
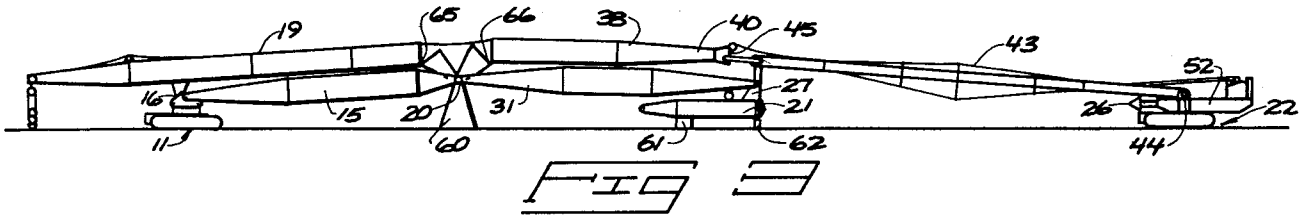

Transporter 11 supports a load platform 14 which is freely rotatable with respect to the transporter 11 about a vertical tower axis 18 (FIG. 1).

Figure 9:
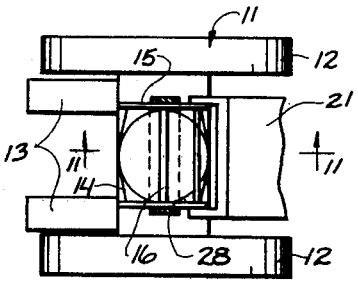
FIG. 9 is a fragmentary enlarged sectional view taken substantially along line 9—9 in FIG. 1.

The lower end of the vertical tower 15 is mounted to platform 14 about a shaft 16 (FIG. 9, 11). The horizontal transverse axis of shaft 16 intersects the vertical tower axis 18. The connection between the platform 14 and the tower 15 at shaft 16 is capable of transmitting turning moments from the platform 14 to the vertical tower 15 about the tower axis 18.

Figure 13:
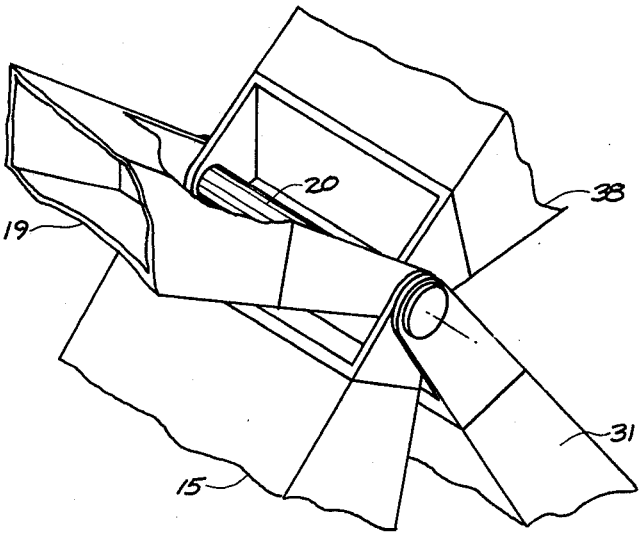
FIG. 13 is a fragmentary enlarged pictorial view of the junction of the present tower, boom, tower brace, and staymast.
Figures 14, 15, 16, 17, 18, 19:
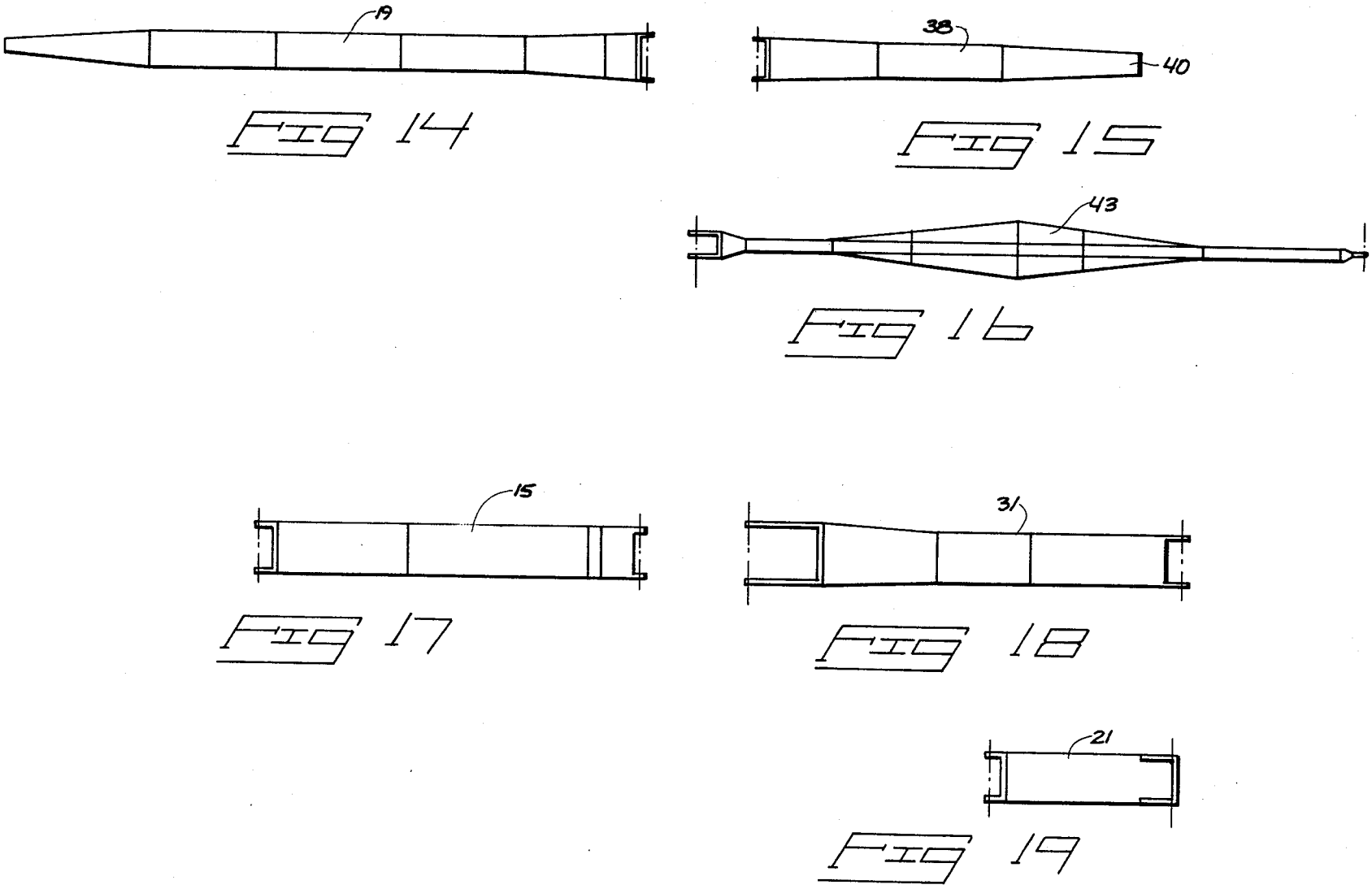
FIG. 14 is an isolated plan view of the boom.
FIG. 15 is an isolated plan view of the staymast.
FIG. 16 is an isolated view of the present counterweight strut.
FIG. 17 is an isolated view of the present tower.
FIG. 18 is an isolated view of the second spreader link or tower brace for the present invention.
FIG. 19 is an isolated view of the stinger or first spreader link of the present invention.

The upper end of the vertical tower 15 pivotally supports a forwardly extending boom 19, which is connected to it about a horizontal transverse shaft 20 (FIG. 13). The axis of shaft 20 is parallel to the axis of shaft 16 at the lower end of vertical tower 15. It also intersects the vertical tower axis 18.

Boom 19 extends angularly upward and radially outward at the front side of tower 15. Its outer end supports a conventional load block 50 for supporting a load shown generally at 51.

Figure 10:
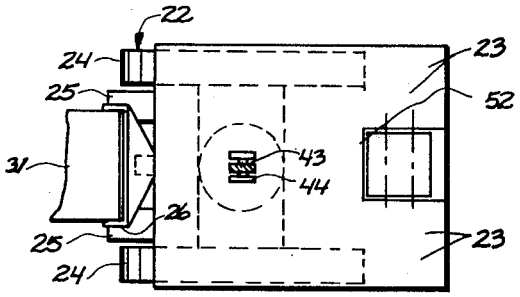
FIG. 10 is an enlarged sectional view taken substantially along line 10—10 in FIG. 1.
Figure 11:
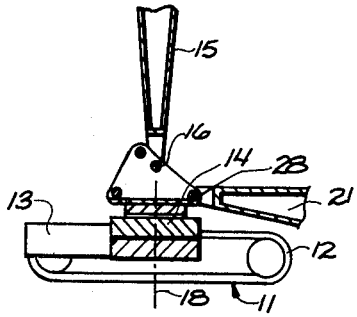
FIG. 11 is a sectional view taken along line 11—11 in FIG. 9.

The counterweight is supported on a second transporter 22 spaced rearwardly behind the tower 15 (FIG. 10). Transporter 22 includes independent tracks 24 driven by internal combustion engines or alternative power sources 25. The transporter 22 carries a counterweight platforms 52 about a vertical pivot axis. Platforms 52 supports removable counterweight blocks 23, which can be varied in number, depending upon the projected loads to be lifted by the apparatus.

Figure 12:
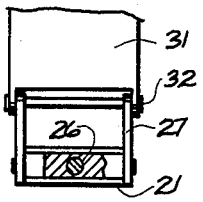
FIG. 12 is a view taken substantially along line 12—12 in FIG. 1.

The counterweight platform 52 is functionally connected to the tower platform 14 by a horizontal rigid spreader link or "stinger" 21. The outer end of stinger 21 is pivotally connected to the platform 52 by a clevis 26. Clevis 26 is interconnected to stinger 21 about a transverse horizontal axis. It is interconnected to the platform 52 about an intersecting longitudinal axis along the length of stinger 21 (FIG. 12), thereby accommodating relative angular movement between platform 52 and stinger 21 about perpendicular axes. Clevis 26 and stinger 21 are also free to move along its longitudinal axis relative to platform 52, providing a third degree of freedom between stinger 21 and the counterweight platform 52. Clevis 26 serves to transmit turning moments from the platform 52 to the tower platform 14 about the tower axis 18. The inner end of stinger 21 is pivotally connected to platform 14 at 28 about a horizontal transverse axis parallel to the axis of the adjacent shaft 16 that supports the lower end of the tower 15.

A second rigid spreader link or tower brace 31 extends between the outer end of stinger 21 and the transverse shaft 20 at the upper end of tower 15. Its lower end is operably connected to platform 52 by being pivotally connected at 32 to an upstanding bracket 27 fixed to the outer end of stinger 21. The tower brace 31 overlays the stinger 21 to form a triangular structure with parallel pivot axis at each corner. Turning or torsional forces on the tower 18 are countered at both its upper and lower ends by the additional structural connections to the counterweight assembly provided through the stinger 21 and tower brace 31. "Winding" of tower 15 due to torsional loading by rotational movement of load 51 and/or counterweight platform 52 about axis 18 is substantially reduced in comparison to the operation of a conventionally counterbalanced tower crane.

The functional interconnections between the counterweight 43, stinger 21 and tower brace 31 are such as to accommodate movement of the platform 52 due to ground variations without transmitting undesirable bending stresses to the connected structural members.

A rigid staymast 38 is also pivoted about shaft 20 at the upper end of tower 15. It extends rearward from tower 15 in diametric opposition 19. Its outer end 40 is positioned vertically above the pivot axis for the counterweight platform 52.

A rigid counterweight strut 32 is vertically mounted between the counterweight platform 52 and the outer end 40 of the staymast 38. Its axis is parallel to axis 18 and coincident with the pivot axis of counterweight platform 52 on transporter 22. A loose pivot connection 44 supports the lower end of counterweight strut 43 on platform 52. Connection 44 might be a ball joint or other loose joint capable of transmitting vertical compression or tension forces, but otherwise leaving the lower end of counterweight strut 43 free to pivot with respect to its supporting platform 52. As shown, the upper end of the counterweight strut 43 is pivotally connected to the outer end 40 of staymast 38 by a connecting shaft 45.

The load block 50 that suspends load 51 from the outer end of boom 19 is operated from a first powered cable drum 30 at the rear of the counterweight platform 52 by means of a moving load line 53. Load line 53 is entrained about conventional sheaves at the outer ends of both boom 19 and staymast 38. The drum 30 is controlled in the conventional manner to raise or lower load 51 with respect to the boom 19.

The angular position of boom 19 about its supporting shaft 20 is varied by control of a boom hoist line 54. Line 54 is wrapped about a powered drum 34 also located at the rear of the counterweight platform 52. Line 54 is played over supporting sheaves at the outer end of staymast 38 and feeds to a boom hoist sheave assembly 55 at the outer end of stationary pendants 56 which are suitably attached to the outer end of boom 19. The boom 19 can be raised or lowered about the transverse axis at shaft 20 by suitable control of the boom hoist line 54.

While the counterweight strut 43 serves as a tension member in resisting a portion of the load directed from the outer end of boom 19 to the counterweight platform 52, it is also vital in its function as a stop to support the outer end of staymast 38 when boom 19 is unloaded. In the absence of the rigid compressive connection provided by strut 43, it would be necessary to severely limit the upward angle at which the unloaded boom 19 could attain. Since this limitation is conventionally assured by using safety straps or cable 57 (FIG. 1), these same cables 57 also limit the upward angular position of boom 19 when lifting a load 51. This will obviously limit the minimum radius at which load 51 can be placed with respect to the tower axis 18. Furthermore, since the long extension of staymast 38 adds substantial rearward forces tending to pull the unloaded boom 19 over tower 15, the design of such a structure would require impractical sizes of safety straps or cables. In the alternative, the heavy short safety straps or cables would severely limit the rearward extension available in the design of staymast 38, in turn limiting the rearward extension of counterweight platform 52 with respect to the tower axis 18. The rigid counterweight strut 43 supports the weight of the staymast 38 when boom 19 is unloaded, and reduces the size of the necessary safety straps or cables 57 to that merely sufficient to prevent overturning of boom 19 due to the turning forces exerted on it about shaft 20 by the weight of the rigging between boom 19 and staymast 38.

A distinct advantage of the present tower crane is its capability of substantial self assembly, particularly through utilization of the counterweight strut 43 as a lifting member. Practical erection of the crane can be accomplished with minimal lifting by external crane assemblies.

FIGS. 3 through 8 show the progressive steps involved in erecting the tower crane. Erection begins with the various elements pivotally connected about shaft 20 and arranged in substantially horizontal positions at ground level. The inner ends of boom 19 and staymast 38 are hinged at 65, 66, respectively. As shown in FIG. 3, a stationary support in the form of a pylon 60 is utilized to temporarily carry the upper pivotal shaft 20 on tower 15. The stinger 21 is also temporarily supported by blocks or other support members 61, 62.

Figure 4:
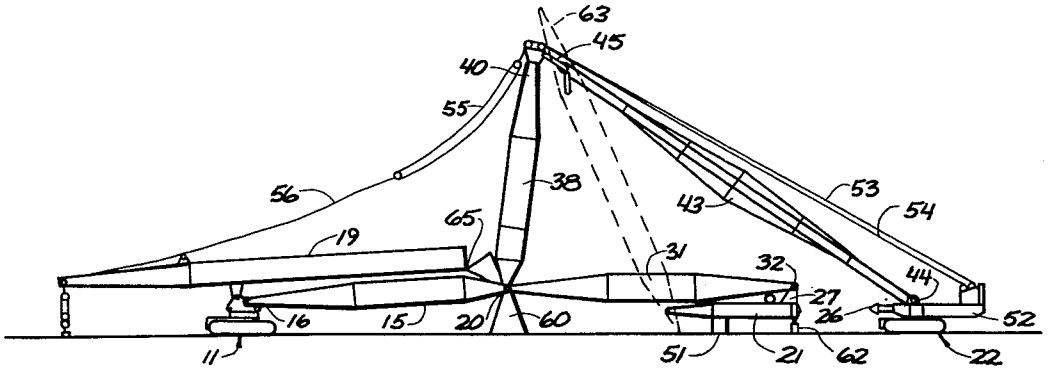
FIGS. 4–8 are views showing the sequence of steps taken to erect the tower crane.
Figure 2:
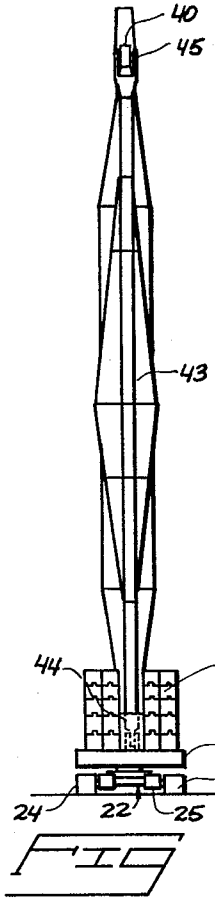
FIG. 2 is a reduced rear view as seen from the right in FIG. 1.
Figure 6:
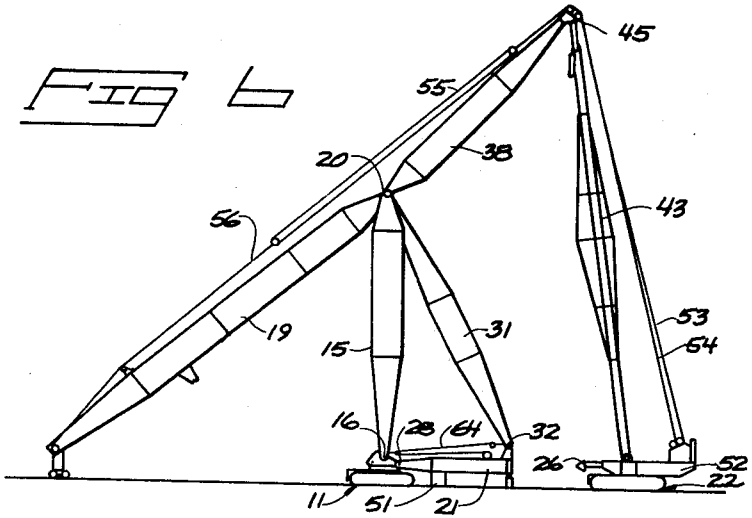

As illustrated in FIG. 4, the initial lift of the outer end 40 of staymast 38 is accomplished by using an external crane unit 63, illustrated in dashed lines. Lifting of staymast 38 is assisted by inward movement of the self-propelled transporter 22 and the interconnection between it and staymast 38 provided by the counterweight strut 43. Staymast 38 is raised to a position almost vertical (FIG. 4), with the stationary pendants 56 and the boom hoist sheave assembly 55 extending between its outer end 40 and the outer end of boom 19.

Figure 5:
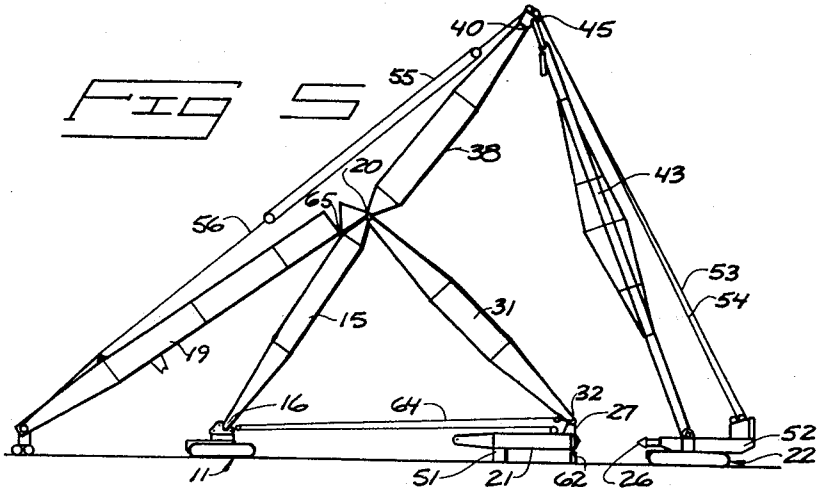

Next, the previously described crane unit 64 is used briefly to initially raise the connection at shaft 20 from its support on pylon 60 upward beyond the horizontally aligned dead center position shown in FIG. 4 to a partially raised position shown in FIG. 5. This lifting is assisted by moving the self-propelled transporter 11 toward the stationary stinger 21. Such movement can be further assisted by powered reeving 64 connected between the platform 14 and bracket 27.

Figure 7:
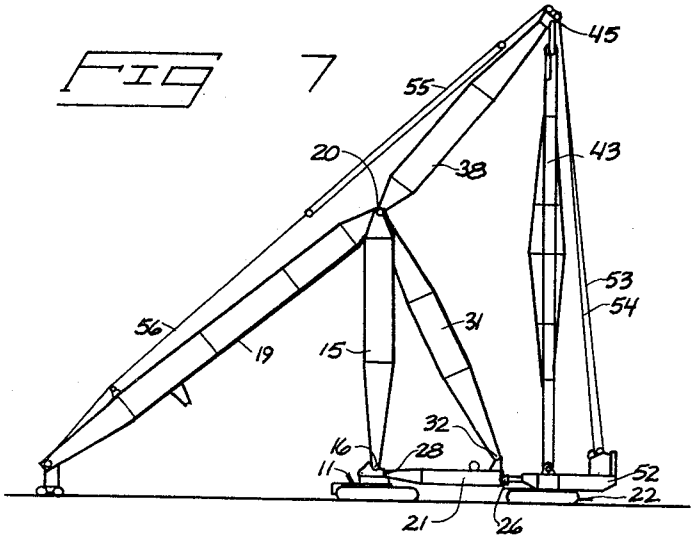

When tower 15 reaches the vertical position (FIG. 6), it is pivotally attached to the inner end of stinger 21, thereby completing the triangular configuration presented by tower 15, stinger 21 and tower brace 31. Transporter 22 is then powered to shift the counterweight strut 43 to a vertical position, also lifting staymast 38 to its operative condition. Clevis 26 on the counterweight platform 52 is then pivotally attached to the outer end of stinger 21 (FIG. 7).

Figure 8:
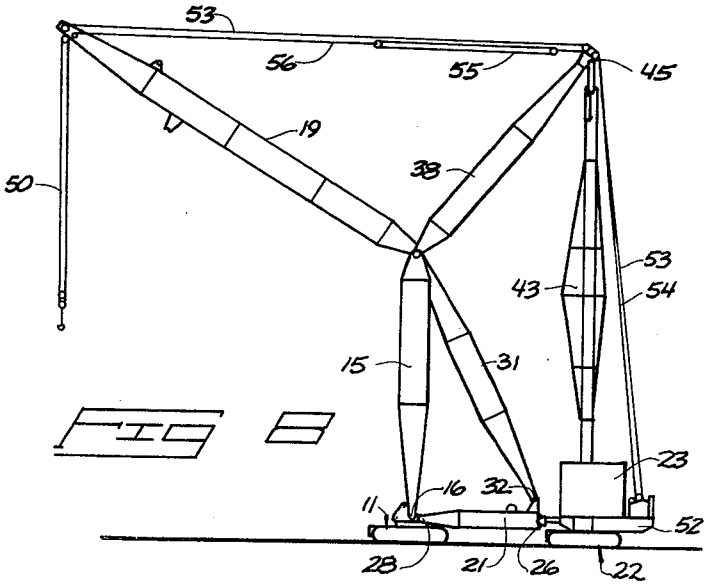

With all of the ground-supported structural elements now connected to one another, the counterweight blocks 23 are mounted on platform 52 and the boom hoist line 54 can be operated to raise the outer end of boom 19 to its working position shown in FIG. 8.

Following erection of the crane elements, the tracks 24 of the transporter 22 are turned 90 degrees under their own power so as to be perpendicular to the stinger 21. With transporter 11 held stationary, the independently powered transporter 22 is utilized to pivot tower 15 about the tower axis 18 through the interconnections provided by the stinger 21 and tower brace 31. It is to be noted that the counterweight unit itself is independently powered and is not moved about tower 15 by applying torque outward from the tower axis 18 to the heavy counterweight structure. This substantially reduces the strength of the structural elements interconnecting the counterweight and tower, while providing the possibility of much greater counterweight mass and weight than is practical with a carriage-supported counterweight assembly.

The described apparatus can be embodied in tower cranes having substantial tower height and boom length, and designed for lifting exceptionally heavy loads over a wide radius relative to the tower axis. It assures tower stability whether the boom is under load or not, and effectively prevents rearward toppling the extended staymast required for substantial separation between the counterweight assembly and tower. While modification of structural details is possible without deviating from this disclosure, the following claims are set out as definitions of the new improvement to a tower crane as discussed in detail above.

Having described my invention, I claim:

1. A counterbalanced tower crane comprising:

a tower platform;

vertical tower means having a lower end mounted to said tower platform for rotational movement about a vertical tower axis;

boom means pivotally mounted to said tower means at an elevation above said tower platform for pivotal movement relative to said tower means about a horizontal axis, said boom means being extended radially outward to one side of the vertical tower axis;

load hoisting means mounted to said boom means;

a mobile counterweight unit spaced a substantial distance radially from said tower platform in diametric opposition to said boom means with respect to said vertical tower axis;

power means mounted to said mobile counterweight unit and operably connected thereto for selectively moving the mobile counterweight unit in a circumferential path about said vertical tower axis;

first rigid spreader link means operably connected to the lower end of said tower means and to said counterweight unit for applying rotational torque to the lower end of said tower means about said vertical tower axis in response to movement of the mobile counterweight unit along said circumferential path;

second rigid spreader link means having one end operably connected to said tower means at a location above the connection of the tower means and said first rigid spreader link means and its remaining end operably connected to said mobile counterweight unit for applying rotational torque to said tower means in conjunction with said first rigid spreader link means; said second rigid spreader link means overlying said first rigid spreader link means in a vertical rigid triangular structure completed by said tower means and located diametrically opposite the boom means;

powered winching means operably connected to said load hoisting means;

a staymast mounted on said tower means;

a rigid vertical counterweight strut having a lower end operably mounted by the mobile counterweight unit and an upper end connected to the outer end of said staymast; and guying means operably connected between said boom means and said staymast.

2. The structure as defined by claim 1 wherein the staymast is pivotably mounted to the tower means about an axis coaxial with said transverse axis.

3. The structure as defined by claim 2 wherein the second rigid spreader link means is also mounted to the tower means about an axis coaxial with said horizontal axis.

4. The structure as defined by claim 1 wherein the counterweight strut is mounted to the mobile counterweight unit by a loose pivot connection thereon.

5. The structure as defined by claim 1 wherein the first rigid spreader link means includes an outer end operably mounted to the mobile counterweight unit and has an upstanding bracket fixed at its outer end for mounting the second rigid spreader link means.

6. The structure as defined by claim 1 wherein the first rigid spreader link means comprises a stinger connected at the respective ends thereof about parallel first and second transverse horizontal axes on said tower means and the mobile counterweight unit; and wherein the second rigid spreader link means comprises a tower brace assembly operably connected at one end to said mobile counterweight unit about a parallel transverse horizontal axis and having its remaining end pivotally connected to said tower means about a further parallel transverse horizontal axis.

7. The structure as defined by claim 6 wherein the staymast is pivotably mounted to the tower means at a transverse horizontal axis.

8. The structure as defined by claim 7 wherein the counterweight strut is mounted to the mobile counterweight unit by a loose pivot connection thereon.

* * * * *